United States Patent [19]

Mastroianni et al.

[11] 4,204,084

[45] May 20, 1980

[54] APPARATUS WITH DIELECTRIC GAS MIXTURES IN SUBSTANTIALLY UNIFORM FIELD

[75] Inventors: Martin J. Mastroianni, East Aurora; Sabatino R. Orfeo, Orchard Park, both of N.Y.

[73] Assignee: Allied Chemical Corporation, Morristown, N.J.

[21] Appl. No.: 919,338

[22] Filed: Jun. 26, 1978

[51] Int. Cl.[2] ..... H01B 3/16

[52] U.S. Cl. ..... 174/25 G; 174/17 GF; 174/26 G; 200/148 G; 252/63.5; 252/66

[58] Field of Search ..... 174/17 GF, 25 G; 361/279, 326; 200/148 G; 252/63.5, 66

[56] References Cited

U.S. PATENT DOCUMENTS

| | | | |
|---|---|---|---|
| 2,757,261 | 7/1956 | Lingal | 252/63.5 X |
| 2,867,679 | 1/1959 | Cobine | 200/148 G |
| 3,059,044 | 10/1962 | Friedrich | 174/18 |
| 3,249,681 | 5/1966 | Eiseman | 174/17 GF |
| 4,071,461 | 1/1978 | Mears | 174/17 GF X |
| 4,110,580 | 8/1978 | Farish | 100/148 G |

OTHER PUBLICATIONS

Mulcachy, M. J., et al., A Review of Insulation Breakdown and Switching in Gas Insulation, INSULATION/CIRCUITS, Aug. 1970, pp. 55 to 61.

Bates, R. D., J of Chem. Physics, V. 57, #10, pp. 4174–4190.

Khodeeva, S. M., Russian J of Physical Chem., vol. 40, #8, pp. 1061–1063 (Aug. 1966).

*Primary Examiner*—Richard R. Kucia

*Attorney, Agent, or Firm*—Alan M. Doernberg; Jay P. Friedenson

[57] ABSTRACT

Dielectric gas mixtures are described with improved dielectric strength in uniform fields compared to pure sulfur hexafluoride. Sulfur hexafluoride is mixed with about 1 to about 10 mole % of a noble gas such as helium, argon, krypton or neon and used in a device wherein the dielectric gas is subjected to a substantially uniform field such as compressed gas insulated cable.

7 Claims, 3 Drawing Figures

APPARATUS WITH DIELECTRIC GAS MIXTURES IN SUBSTANTIALLY UNIFORM FIELD

BACKGROUND OF THE INVENTION

Sulfur hexafluoride has found increasing use as a dielectric gas in high voltage electrical applications wherein the dielectric gas is subject to a substantially uniform electrical field. Such applications include compressed gas insulated cables of the type used in power distribution substations for cables carrying high voltages, such as over about 100 kilovolts. The ratings of a cable of this type depends on a combination of the dielectric gas, the pressure to which the gas is subjected and the gap between conductors filled by the gas. An improved dielectric gas would improve the rated voltage if the other factors were held constant or permit a relaxation of some other factor while retaining rated voltage.

Many attempts have been made to formulate dielectric gases including gas mixtures of sulfur hexafluoride with improved electrical properties. Thus such mixtures have been discovered with improved dielectric strength in non-uniform fields or with dielectric strengths comparable to pure sulfur hexafluoride combined with improved other properties such as lowered dew points. Nevertheless other improved dielectric gases are still sought having such improved properties, especially for devices of the type wherein the gas is subjected to a substantially uniform field.

BRIEF DESCRIPTION OF THE INVENTION

The invention includes an improvement in an electrical apparatus of the type having at least two electrical conductors separated by an insulative dielectric gas subjected to a substantially uniform electrical field. In the improvement, the insulative gas consists essentially of about 1 to about 10 mole % of a noble gas preferrably selected from the group consisting of helium, argon, krypton and neon, and about 90 to about 99 mole % of sulfur hexafluoride.

The subject dielectric gas mixtures have increased dielectric strength compared to pure sulfur hexafluoride and have potential advantages of lowered dew point and increased thermal conductivity.

DETAILED DESCRIPTION OF THE INVENTION

The present invention is concerned with dielectric gases for a high voltage apparatus or device with a substantially uniform electrical field. By "substantially uniform electrical field" is meant a sphere to sphere, sphere to plane, or two coaxial cables or the like. Examples of such devices are short sections of bus and longer lengths of compressed gas insulated transmission systems rated between 145 to 800 kv, rms.

The present dielectric gas consist essentially of sulfur hexafluoride and a noble gas. The noble gas is about about 1–10 percent of the mixture. In preferred devices, the dielectric gas is at a pressure between about 15 and about 100 psia (about 760 to 7600 millimeters of mercury absolute). More preferred is about 45–65 psia (about 2375 to 3400 mm Hg abs). Each of the noble gases, helium, neon, argon and krypton is found in some preferred gas mixtures, with the following examples showing synergistic breakdown voltages in uniform fields for helium, argon or krypton. Mixtures of noble gases are not excluded from the present invention, but they are generally not preferred.

The present dielectric gases may be used in the apparatus or device in the conventional manner now used for pure sulfur hexafluoride. The construction and introduction of such a gas into such devices are well known to the art and described, for example, in *Compressed Gas Insulated Transmission Systems: The Present and Future,* by A. H. Cookson of Westinghouse Electric Corp.

EXAMPLE 1

Figure 1:
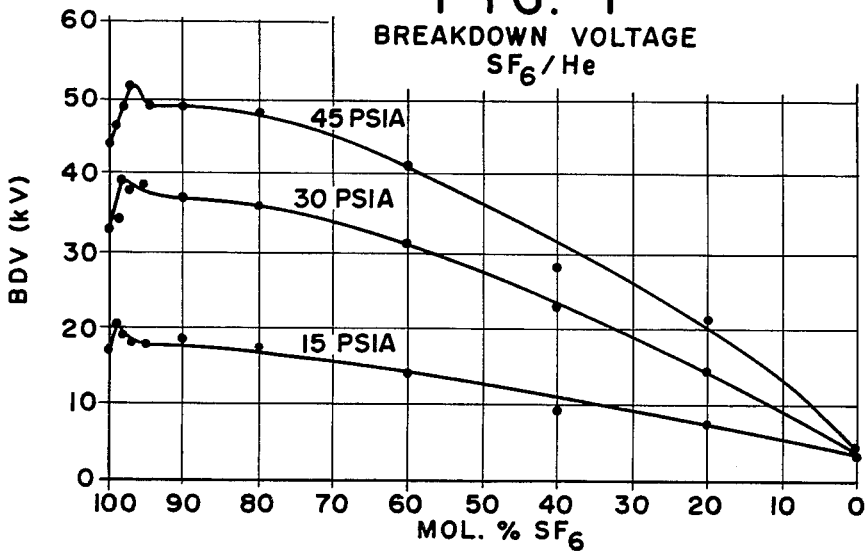
FIGS. 1 to 3 contain curves of the breakdown voltage of gas mixtures at various pressures.

Mixtures of sulfur hexafluoride and 1, 2, 3, 4, 6, 10, 20, 40 and 80 mole % helium were prepared and tested for breakdown voltage in a uniform field against pure sulfur hexafluoride and pure helium. The test cell included sphere to plane electrodes at 0.1 inch gap. Such tests were conducted at 15 psia, 30 psia and 45 psia which correspond to about 790, 1580, and 2370 millimeters of mercury absolute or about 103, 206 and 310 kPa. In these tests, the gases were injected into an evacuated test cell to give the desired concentration and the voltage increased until breakdown occurred. The results at 30 psia are tabulated in Table 1, and the results at all three pressures are displayed in FIG. 1.

EXAMPLES 2–3 AND COMPARATIVE EXAMPLES 4–7

Figure 2:
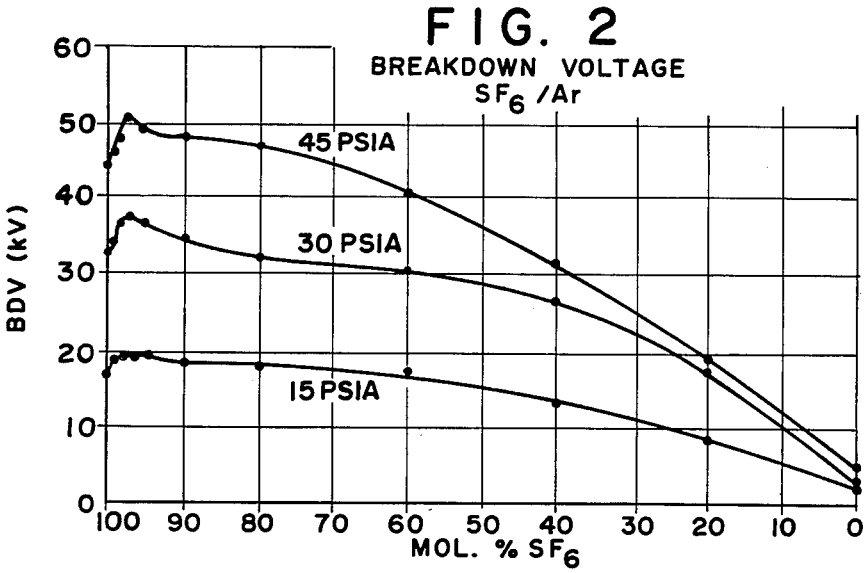
Figure 3:
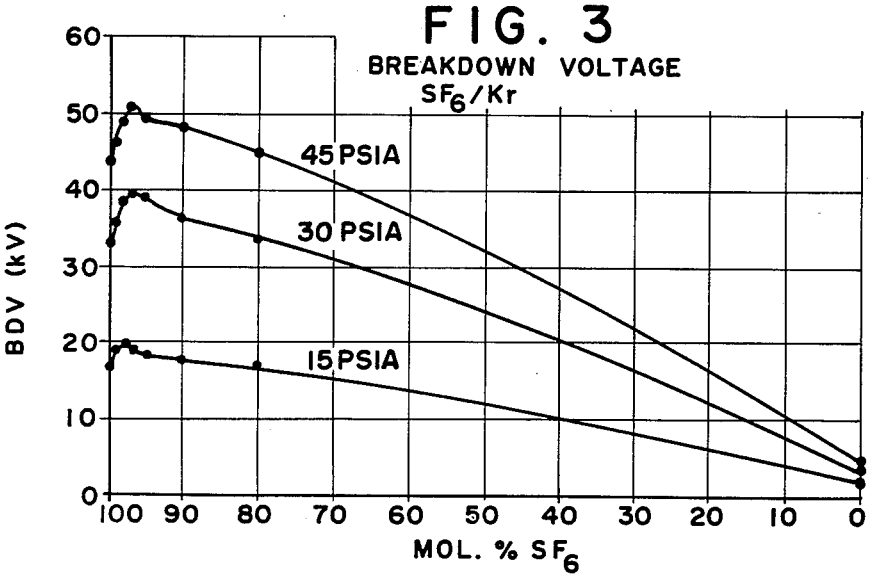

Example 1 was repeated, with fewer sampling points in some cases, with mixtures of sulfur hexafluoride and argon (Example 2), krypton (Example 3), hydrogen (Comparative Example 4), nitrogen (Comparative Example 5), $C_2F_6$ (Comparative Example 6) and $CCl_2F_2$ (Comparative Example 7). The results at 30 psia are tabulated in Table 1, and, for examples 2 and 3, the results at all three pressures are displayed in FIGS. 2 and 3. None of the Comparative Examples show the marked synergism at about 80–99 mole % sulfur hexafluoride that is displayed by the noble gases in Examples 1–3.

COMPARATIVE EXAMPLES 8 AND 9

Example 1 and 2 were repeated for $CF_4$ and 0, 1, 2, 3, 5, 10 and 20 mole % noble gas (helium in 8, argon in 9). As shown in Table 2, some synergism was shown compared to the base values for $CF_4$, but the increase was much less than as shown for sulfur hexafluoride-noble gases in Table 1.

TABLE 1

| Sphere to plane electrodes, 0.1 inch gap, 30 psia(103KPa) | | | | | | | |
|---|---|---|---|---|---|---|---|
| Mole % $SF_6$ | Ex. 1 $SF_6$-He BDV (KV, rms) | Ex. 2 $SF_6$-Ar | Ex. 3 $Sf_6$-Kr | Comp. Ex. 4 $SF_6$-$H_2$ | Comp. Ex. 5 $SF_6$-$N_2$ | Comp. Ex. 6 $SF_6$-$C_2F_6$ | Comp. Ex. 7 $SF_6$-$CCl_2F_2$ |
| 100 | 33.3 | 33.7 | 33.7 | 33.4 | 33.1 | 33.0 | 33.1 |
| 99 | 35.6 | 36.0 | 33.6 | 32.8 | 32.9 | 33.1 | |
| 98 | 38.5 | 37.3 | 38.7 | 33.5 | 33.0 | 33.0 | 33.0 |
| 97 | 38.1 | 37.5 | 39.4 | 33.0 | 32.8 | 32.9 | 33.0 |
| 96 | 38.0 | 36.6 | 39.2 | 32.9 | 32.6 | 33.1 | — |
| 94 | 37.4 | 36.3 | 38.9 | 32.7 | 32.4 | — | — |
| 90 | 36.2 | 35.1 | 36.3 | 32.0 | 31.9 | 32.3 | 33.7 |
| 80 | 36.2 | 32.6 | 33.2 | — | 31.6 | 31.3 | 34.2 |
| 60 | 31.8 | 30.6 | — | — | — | 29.5 | 33.6 |
| 40 | 23.4 | 26.4 | — | — | — | 27.5 | 32.6 |
| 20 | 14.3 | 18.2 | — | — | — | 26.4 | 30.6 |
| 0 | 4.8 | 2.5 | 4.2 | — | — | 25.5 | 28.3 |

Table 2

| Mole % Noble Gas | Comp. Ex. 8 $CF_4$-He | Comp. Ex. 9 $CF_4$-Ar |
|---|---|---|
| 0 | 14.3 | 14.3 |
| 1 | 14.5 | 14.5 |
| 2 | 14.6 | 14.6 |
| 3 | 14.3 | 14.6 |
| 5 | 14.4 | 14.6 |
| 10 | 14.3 | 14.5 |
| 20 | 14.1 | 14.3 |

What is claimed is:

1. In a high voltage electrical apparatus having at least two electrical conductors separated by an insulative dielectric gas subjected to a substantially uniform electrical field, the improvement wherein the insulative gas consists essentially of about 1 to about 10 mole % of a noble gas and about 90 to about 99 mole % of sulfur hexafluoride.

2. The apparatus of claim 1 wherein said insulative gas is at a pressure between about 40 and 70 psia.

3. The apparatus of claim 1 wherein said noble gas is helium.

4. The apparatus of claim 1 wherein said noble gas is neon.

5. The apparatus of claim 1 wherein said noble gas is argon.

6. The apparatus of claim 1 wherein said noble gas is krypton.

7. The apparatus of claim 1 being a compressed gas insulated cable.

* * * * *

UNITED STATES PATENT AND TRADEMARK OFFICE

CERTIFICATE OF CORRECTION

PATENT NO. : 4,204,084

DATED : May 20, 1980

INVENTOR(S) : M. J. Mastroianni et al.

It is certified that error appears in the above-identified patent and that said Letters Patent are hereby corrected as shown below:

Columns 3 and 4, line beginning with "99" of Table 1: change

| | | | | | | | |
|---|---|---|---|---|---|---|---|
| "99 | 35.6 | 36.0 | 33.6 | 32.8 | 32.9 | 33.1 | " to |
| --99 | 35.6 | 36.0 | 36.1 | 33.6 | 32.8 | 32.9 | 33.1--. |

Signed and Sealed this

*Twelfth* Day of *August 1980*

[SEAL]

*Attest:*

SIDNEY A. DIAMOND

*Attesting Officer*

*Commissioner of Patents and Trademarks*